United States Patent [19]

Loikitz

[11] 4,215,449

[45] Aug. 5, 1980

[54] SELF-CLOSING HINGE

[75] Inventor: Frank F. Loikitz, Middletown, N.J.

[73] Assignee: Standard Keil Hardware Manufacturing Co., Allenwood, N.J.

[21] Appl. No.: 942,849

[22] Filed: Sep. 15, 1978

[51] Int. Cl.[2] ..... E05F 3/20

[52] U.S. Cl. ..... 16/50; 16/137; 16/153; 16/189; 16/191

[58] Field of Search ..... 16/50, 189, 182, 68, 16/75, 76, 82, 85, 137, 174, 139, 143, 186, 153, 191

[56] References Cited

U.S. PATENT DOCUMENTS

| | | | |
|---|---|---|---|
| 2,538,679 | 1/1951 | Foltis | 16/68 |
| 3,518,716 | 7/1970 | Larson | 16/50 X |
| 3,537,126 | 11/1970 | Nakanishi | 16/50 |
| 3,602,942 | 9/1971 | Neff et al. | 16/191 |

*Primary Examiner*—George H. Krizmanich

*Attorney, Agent, or Firm*—Blum, Kaplan, Friedman, Silberman & Beran

[57] ABSTRACT

A self-closing, non-rising hinge in cartridge form fits into a socket, generally, in the upper edge of a door. The hinge mechanism is completely enclosed within a housing and provides a strong returning force for closing a door. The hinge is reversible in that it can be mounted for opening the door either from the left or from the right. Where two doors are present, one above the other, as in refrigerators, the hinge may be inserted, in inverted position, into the lower edge of the door to minimize space requirements.

13 Claims, 8 Drawing Figures

FIG. 2
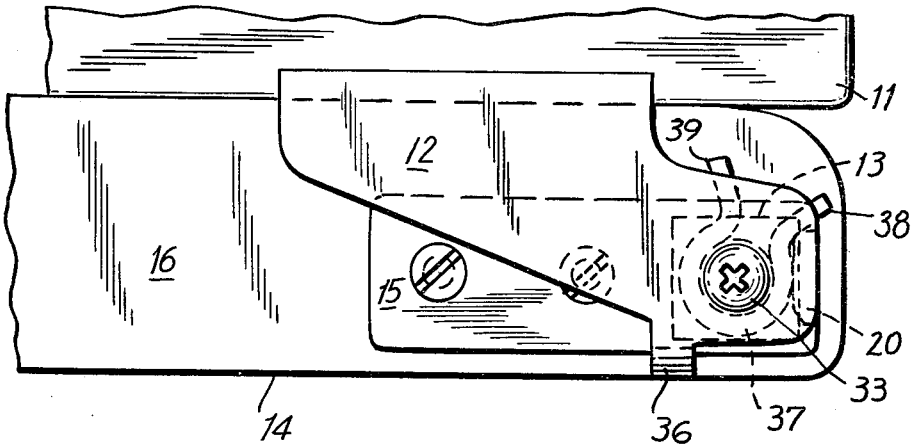
FIG. 3
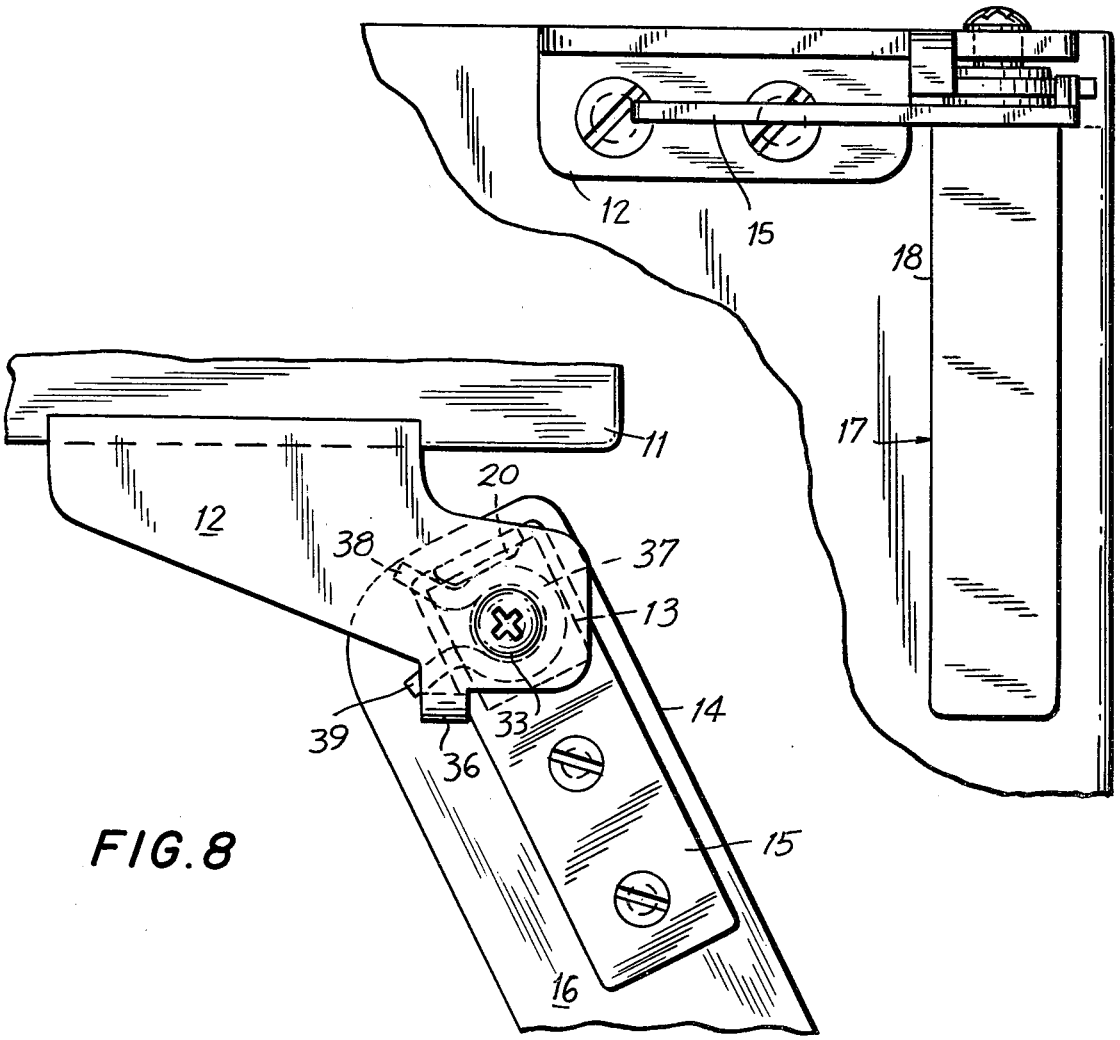
FIG. 8

SELF-CLOSING HINGE

BACKGROUND OF THE INVENTION

Over the course of years, a wide variety of hinges for automatically closing doors have been developed. U.S. Pat. No. 165,619 discloses a self-closing hinge for a gate which includes cams so shaped that as the gate is opened, an upper cam which is attached to the gate rides upwardly on a lower cam which is attached to the gatepost. Gravity then provides the restoring force for returning the gate to closed position. The patent also shows a flat having a small depression therein for providing a dwell so that if the gate is open far enough the gate will remain open until it is partially closed by hand. U.S. Pat. No. 571,133 discloses a spring hinge utilizing a coil spring for returning the spring to closed position. However, the spring is used in torsion, a method of use which has the disadvantage of shortening the life of the spring.

U.S. Pat. No. 3,518,716 shows a hinge in which a cam moves vertically within a housing and is locked thereto for rotation therewith by contact between flat regions on each of the cam and the housing. However, wear soon decreases the efficacy of this locking means. In addition, wear takes place between a coil spring and a pin passing therethrough.

While the general principles of self-closure, cam action and a dwell are known, substantial disadvantages have been present in conventional structures, these disadvantages being the aforenoted shortened life of a spring member used in torsion, relative axial motion of the spring halves which results in an undesired vertical motion of a door equipped with such a hinge and the requirement for different hinge structures for left and right mounted doors. As is evident, a hinge structure which avoids such disadvantages is greatly to be desired.

SUMMARY OF THE INVENTION

A hinge in accordance with the present invention has a housing which fits into a suitably-shaped socket in either the upper or the lower edge of a door of an enclosure. For convenience, the description of the hinge will be presented in terms of use of the hinge at said upper edge, but it is to be understood that the hinge, without necessitating any modifications, will operate equally well when inserted into a socket in the lower edge. The housing has a flange which can be affixed to the top edge of the door so that the housing rotates with the door. The housing which is elongated and which is mounted in generally vertical orientation in the door has a pin therin which extends in the lengthwise direction of the housing, one end of the pin protruding through the upper end of the housing. Said top end of the pin is shaped to lock into a support bracket fastened to the door enclosure so that the pin is non-rotational with respect to the support bracket, accordingly, the housing and the pin rotate relative to each other.

A male cam member is rigidly affixed to the pin and a female cam member is keyed to the housing so that it can move only in an axial direction with respect to the housing and to the pin. Said female cam thus rotates with said housing relative to said pin. The cam members have mating surfaces so shaped that rotation of the housing about the pin as the door is moved from closed to open position moves the cam members apart axially. A compression spring biases the cam members together and supplies the force for restoring the door to which the hinge is fitted from open to closed position and for holding door sealingly against the enclosure. Preferably, the biasing member is a coil spring. The cam members and the coil spring are completely enclosed by said housing and are thereby protected from dust and the like.

The cam members are essentially symmetrical so that the hinge can be fitted to a door for opening either to the left or to the right and, as afore-noted, can be fitted either to the top or bottom edge of a door. Preferably, the female cam member has a flat on its mating surface, the flat providing for a dwell.

Also, in a preferred embodiment, an auxiliary spring and stops on the hinger and on an associated hinge bracket are arranged for cooperating to provide a warning when the door approaches a degree of opening which may cause damage to nearby cabinetry. The warning is in the form of substantially increased resistance to opening the door further.

Accordingly, an object of the present invention is a self-closing, non-rising hinge of long life.

A further object of the present invention is a self-closing, non-rising hinge which utilizes a compression spring as a closure force.

Another object of the present invention is a self-closing, non-rising hinge which is reversible and can be fitted either to the bottom or the top of a door.

Yet another object of the present invention is a self-closing, non-rising hinge which provides a warning against opening the door to an excessive extent.

An important object of the present invention is a self-closing, non-rising hinge in cartridge form.

A significant object of the present invention is a self-closing, non-rising hinge which provides for dwell and which is free of any requirement for adjustment.

Yet a further object of the present invention is a self-closing, non-rising hinge which provides for exertion of a positive, sealing force, when a door fitted with said hinge is in closed position.

Still other objects and advantages of the invention will in part be obvious and will in part be apparent from the specification.

The invention accordingly comprises the features of construction, combination of elements, and arrangements of parts which will be exemplified in the construction hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which:

FIG. 2 is a top view of a door and an enclosure to which said hinge and top bracket are affixed;

FIG. 3 is a side view of the hinge and bracket of FIG. 2;

FIG. 8 is a top view of said hinge and top bracket when said door is in fully-opened position and said hinge is activated for giving warning against opening said door further.

DESCRIPTION OF THE PREFERRED EMBODIMENTS

Figure 1:
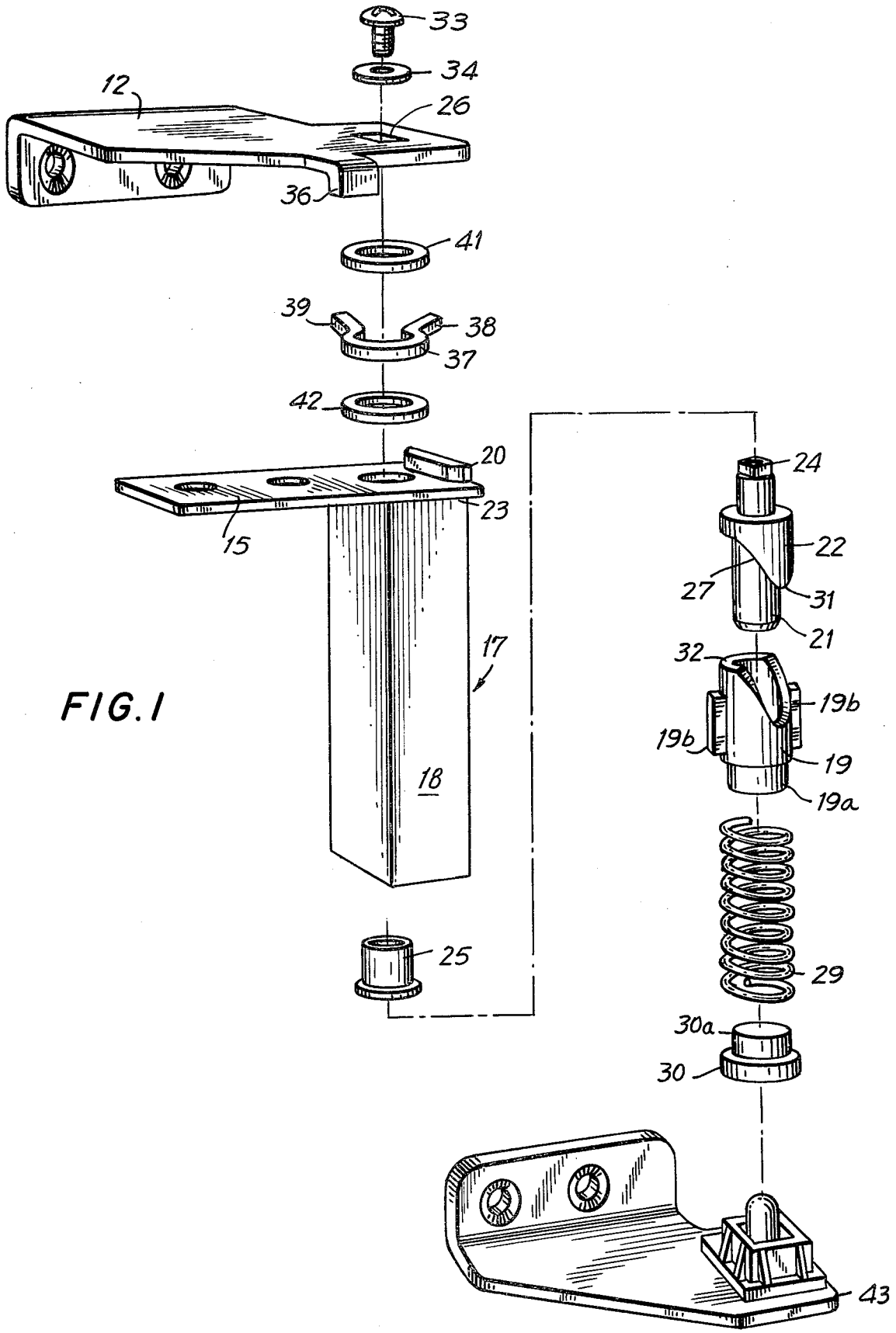
FIG. 1 is an exploded view of a cartridge hinge in accordance with the present invention and the associated top and bottom brackets.
Figure 4:
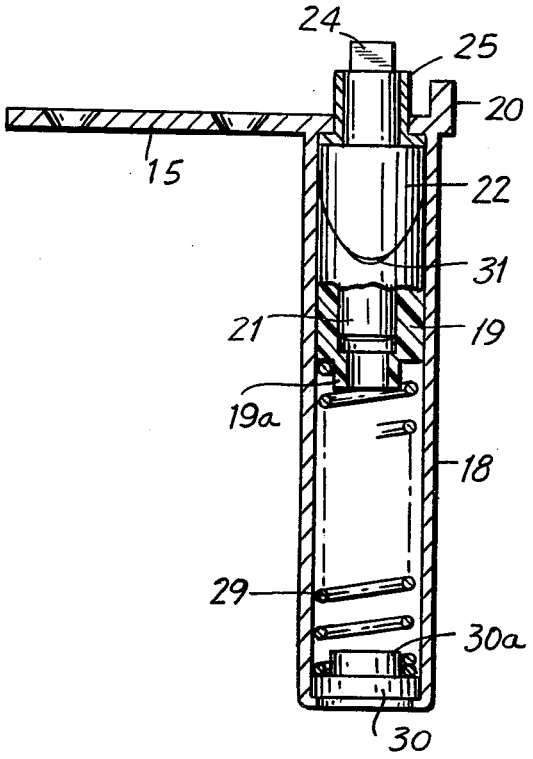
FIG. 4 is a side view in section of said hinge, said view showing the relationship of a male cam member and a female cam member when the door to which said hinge is fitted is in closed position.
Figure 5:
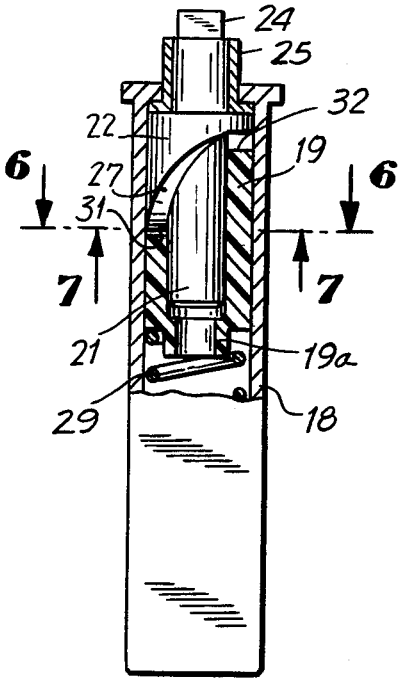
FIG. 5 is an end partial view in section of said hinge.
Figure 6:
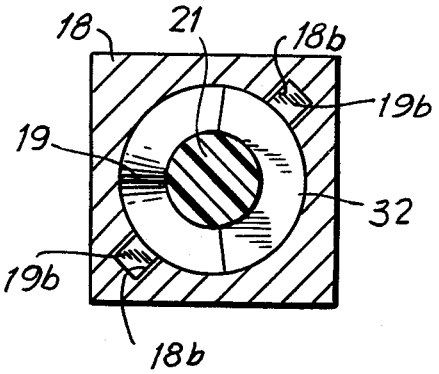
FIG. 6 is a view along line 6—6 of FIG. 5.

A cartridge hinge, indicatd generally by the reference numeral 17 is shown in exploded form in FIG. 1, said hinge being arranged and constructed for mating with support bracket 12 which has a configuration rendering it suitable for attachment to the top right-hand edge or bottom left-hand edge of a door opening. As aforenoted, the cartridge hinge of the present invention can be fitted for either right-hand or left-hand opening of a door and either to the top or to the bottom edge of the door. The construction and operation of cartridge hinge 17 will be presented for the configuration shown in the FIGS., namely for the configuration in which the hinge is fitted to the top edge proximate the right-hand side of a door. However, one skilled in the art will readily recognize how the hinge can be fitted to any of the other three positions. The hinge is particularly suitable for use with a box such as a refrigerator.

Cartridge hinge 17 has rigidly affixed to the upper end 23 thereof a flange 15 which can be fastened to the top edge 16 (FIG. 2) of the door 14 to ensure that the cartridge housing will rotate with said door. The cartridge hinge 17 sits within a socket 13 indicated in phantom in FIG. 2.

Hinge 17 has an elongated housing 18 holding a male cam member 22, a pin 21 within said cam member and extending through the upper end 23 of said housing and a female cam member 19. Pin 21 passes through bushing 25 in housing 18 so that said housing can rotate relative to said pin. Male cam member 22 is rigidly affixed to said pin 21 and preferably is integral therewith so that said housing rotates relative to said male cam member as well as relative to said pin. Female cam member 19 as shown in FIGS. 1, 4, 5 and 6 is slidingly keyed to said housing 18 by ridges **19*b* on lower cam member 19, housing 18 having corresponding slots 18*b* on the interior thereof. These slots may conveniently be provided proximate two vertical edges of housing 18 in FIGS. 6 and 7. This structure provides that said female cam member rotates with said housing relative to male cam member and moves axially relative to said housing. Pin 21 protrudes through upper surface 23 of housing 18 and has an upper end 24 which keys into aperture 26 of support plate 12. The structure of cartridge hinge 17 is therefore such that housing 18 and female cam member 19 keyed thereto rotate with door 14 while pin 21 and nake cam member 22 remain stationary when door 14 is opened and closed. However, mating surfaces 27 of male cam member 22 and 28 of female cam member 19 are so shaped that relative rotation of said cam members causes them to move apart in the axial direction. Said cam members are biased toward each other by coil spring 29. As shown in FIG. 1, female cam member 19 is positioned between cam member 22 and coil spring 29. Furthermore, coil spring 29 is held under compression in housing 18 even when pin 21 is in a position relative to housing 18 corresponding to the closed position of door 14, thereby providing for positive closure of door 14** even when said door is opened only through a small angle.

Figure 7:
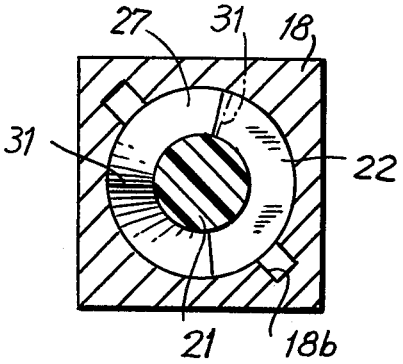
FIG. 7 is a view along line 7—7 of FIG. 5.

The relative position of cam members 19 and 22 when housing 18, in door 14, is rotated through an angle in excess of 90° is shown in FIG. 7. As is evident, female cam member 19 has been displaced axially from male cam member 22 as the result of the shape of the mating surfaces 27 and 28, these surfaces having a shape which approximates that of a V. The wedge action results in an axial force as the two cam members are rotated relative to each other. The shape of female cam member 19 is more clearly seen in FIGS. 4 and 5. Displacement of said cam member 19 in the axial direction results in compression of coil spring 29 which provides the restoring force to return door 14 to the closed position as the result of urging cam member 19 toward cam member 22.

As is best seen in FIG. 7 and shown in phantom, when tip 31 of male cam member 22 makes contact with portion 32 of surface 28 of female cam member 19, the only force exerted by one cam member on the other is axial. As a result, when housing 18 is rotated more than 90° from closed position relative to male cam member 22, there is a complete absence of any rotational torque and a dwell is provided. In general, the dwell portion of a hinge corresponds to a rotation, in either direction, that is, either clockwise or counter clockwise, which is somewhat in excess of 90°, a convenient angle being about 110°.

FIG. 7 shows the location of tip 31 of male cam member 22 as it just reaches contact with dwell portion 32 of female cam member 19. The construction of hinge 17 provides for rotation of the door through an angle of about 180°. However, opening of the door through so large an angle may result in damage to nearby furniture or cabinetry. To provide a warning that the extent to which the door is rotated is becoming excessive, hinge 17 is provided with an ear 20 projecting above flange 15, and bracket 12 is provided with a downwardly-extending finger 36. A stop spring 37 is disposed around bushing 25 and has ends 38 and 39 which are engaged by ear 20 and by finger 39 and forced toward each other when the degree of opening said door 14 reaches a selected critical angle. This angle, conveniently, is about 160°. The warning given by hinge 17 takes the form of a substantially-increased resistance to further opening of the door. The join between ear 20 and housing 18 is deliberately such that ear 20 can be sheared off if the door is opened through a sufficient angle, thus avoiding damage to said housing or said door. As is evident, if said ear 20 is sheared off, warning will no longer be given by the hinge, but, nevertheless, said hinge and said door remain operable.

Also evident is the fact that upper cam member 22 could be female and lower cam member 19 could be male so far as the shapes of the mating cam surfaces are concerned without affecting the operation of the hinge of the present invention.

It will be noted that the combination of the stop spring, ear and finger provide a semi-positive stop against further opening of the door. Also, it has been found desirable that the torque necessary for shearing off ear 20 be in the neighborhood of 100 foot-lbs.

Operability of hinge 17 at either the left edge or the right edge of a door is provided by making the cams symmetrical with respect to each other. A further point to be noted is that the necessary restoring force is provided by a single hinge so that a similar hinge construction is not needed at the bottom of door 14. Also, since hinge 17 is of the non-rising type, it can be used with a door frame in a wall, the frame in such a case corresponding to box 11.

It will be noted that pin 21 is held to support plate 12 only by means of machine screw 33 and washer 34, no provision for adjustment of any type being necessary. Also, the force of the spring against female cam member 19 provides a strong and positive torque for closing door 14, especially when one of the cam members is of a material having a low coefficient-of-friction, a suitable material being nylon, the other being of zinc.

The construction of the cartridge hinge is such as to ensure long operating life. Thus, the cartridge housing 18 completely encloses all of the components. Pin 21 does not extend into the coil spring 29, thus avoiding friction wear. The lower end of spring 29 fits around boss 30*a* on bottom plug 30 and the upper end of said spring is located by boss 19*a* on female cam member 19 so that spring 29 is definitely positioned axially in housing 18 and prevented from rubbing against the interior of said housing. Also, nylon washers 41 and 42 are positioned above and below stop spring 37 to prevent friction with bracket 12 and flange 15.

A bottom bracket 43 is shown in FIG. 1. As is evident, bottom bracket 43 may be used for holding the top edge of a door when hinge 17 is positioned at a bottom edge.

It will thus be seen that the objects set forth above, among those made apparent from the preceding description, are efficiently attained and, since certain changes may be made in the above construction without departing from the spirit and scope of the invention, it is inded that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

What is claimed is:

1. A non-rising, reversible-hinge in cartridge form, comprising:

an elongated housing shaped for fitting vertically into a socket in the top or bottom edge of a door, said housing when positioned for mounting in said top edge having an upper end and a lower end, and vertical slot means in the interior thereof;

top flange means rigidly affixed to said housing for anchoring said housing to said top edge of said door and thereby assuring that said housing will rotate with said door;

pin means within the upper portion of said housing and extending sufficiently above said housing to engage a support bracket, said housing and said flange means being arranged and constructed for permitting said pin means to protrude through said upper end and for permitting revolution of said housing relative to said pin means; said pin means having an upper end arranged and constructed for keying into said support bracket for preventing rotation of said pin means when said door is open;

a male cam member rigidly affixed to said pin means and having a lower cam surface;

a female cam member having an upper cam surface for engaging with said lower cam surface, a vertical, generally cylindrical exterior surface, and projection means on said exterior surface for engaging said vertical slot in said housing, thereby providing for rotation of said female cam member with said housing and for rotation of said female cam member relative to said male cam member; and coil spring means disposed between said female cam member and said lower end for biasing said female cam member upwardly against said male cam member, said cam surfaces being shaped for forcing said cam members apart against the urging of said coil spring means when said door is opened and for converting the upward force of said spring means into a torque directed for closing said door, said coil spring means being free of pin means within same.

2. A non-rising, reversible hinge member as recited in claim 1, wherein said projection means comprises a pair of spaced-apart vertical ridges and said slot means comprises a pair of correspondingly-positioned pair of slots constructed and arranged for permitting vertical displacement of said ridges therein while constraining said ridges and thereby said female cam member against angular displacement relative to said housing.

3. A non-rising, reversible hinge member as recited in claim 1, wherein said pin means is integral with said male cam member.

4. The non-rising, reversible hinge, as recited in claim 1, wherein at least one of said cam surfaces has a shape which provides for a dwell, defined as a specific angle of rotation of said pin relative to said housing in which said coil spring means, in combination with said cam members, provides a force which is free of rotational component.

5. The non-rising, reversible hinge, as defined in claim 4, wherein one of said upper cam surface of said female cam member includes a flat portion for providing said dwell.

6. The non-rising, reversible hinge, as defined in claim 5, wherein said specific angle of rotation corresponds to a door opening of about 110°.

7. The non-rising, reversible hinge, as defined in claim 1, wherein one of said cam members is of a synthetic resin having a low coefficient of friction.

8. The non-rising, reversible hinge, as defined in claim 7, wherein said synthetic resin is nylon.

9. The non-rising, reversible hinge, as defined in claim 1, wherein said mating surfaces are symmetrical with respect to the direction of rotation of said first cam member relative to said second cam member thereby making said hinge member suitable for both right and left mounting.

10. The non-rising, reversible hinge, as defined in claim 1, wherein said coil spring is positioned within said housing for prevention of friction contact therebetween.

11. The non-rising, reversible hinge, as defined in claim 1, further comprising a support bracket having an opening for receiving said pin means and holding same against rotation and having a downwardly extending finger and a stop spring disposed between said bracket and said housing, said housing having an ear extending above said housing, said top spring being constructed and adapted for engaging said finger and ear and being compressed by said ear and said finger when said door is rotated through an angle considered excessive, thereby giving rise to a substantial increase in resistance to further rotation of said door, this increase constituting a warning against further opening of said door.

12. The non-rising, reversible hinge, as defined in claim 11, wherein said angle is about 160°.

13. The non-rising, reversible hinge, as defined in claim 11, wherein said ear is jointed to said housing in a construction such that said ear can be sheared by a force of about 100 ft-lb exerted on a door to which said hinge is affixed.

* * * * *